US009913325B1

(12) United States Patent
Mi

(10) Patent No.: US 9,913,325 B1
(45) Date of Patent: Mar. 6, 2018

(54) LED DIRECT AC DRIVE CIRCUIT

(71) Applicant: SEMICONDUCTOR COMPONENTS INDUSTRIES, LLC, Phoenix, AZ (US)

(72) Inventor: Ningliang Mi, Arlington Heights, IL (US)

(73) Assignee: Semiconductor Components Industries, LLC, Phoenix, AZ (US)

( * ) Notice: Subject to any disclaimer, the term of this patent is extended or adjusted under 35 U.S.C. 154(b) by 0 days.

(21) Appl. No.: 15/423,775

(22) Filed: Feb. 3, 2017

(51) Int. Cl.
*H05B 33/08* (2006.01)

(52) U.S. Cl.
CPC ..... *H05B 33/0809* (2013.01); *H05B 33/083* (2013.01); *H05B 33/0845* (2013.01)

(58) Field of Classification Search
CPC ..... H05B 33/0809; H05B 33/083; H05B 33/0845
USPC ..... 315/185 R
See application file for complete search history.

(56) References Cited

U.S. PATENT DOCUMENTS 7,081,722 B1 * 7/2006 Huynh ..... H05B 33/0818 315/185 S
8,686,649 B2 * 4/2014 Shin ..... H05B 33/083 315/123
8,686,651 B2 * 4/2014 Lynch ..... H05B 33/0818 315/192
8,928,254 B2 * 1/2015 Jeong ..... H05B 33/083 315/122
8,952,620 B2 2/2015 Jeong et al.
9,041,303 B2 * 5/2015 Yoon ..... H05B 33/0821 315/192
9,426,857 B2 * 8/2016 Jong ..... H05B 33/0818
2014/0042918 A1 * 2/2014 Lee ..... H05B 33/0809 315/185 R
2016/0143107 A1 * 5/2016 Kim ..... H05B 33/0887 315/121
2016/0150607 A1 * 5/2016 Kim ..... H05B 33/0815 315/210
2016/0174327 A1 * 6/2016 Kim ..... H05B 33/0884 315/297
2016/0227617 A1 * 8/2016 Kim ..... H05B 33/0845

OTHER PUBLICATIONS

FL77944—Analog/PWM/Phase-cut Dimmable High Power LED Direct AC Drive, Jul. 2016, pp. 1-10.
AN4188—Guidance of Using LED Direct-AC Driver Design Tool for FL77904/FL77944/FL77905, Jul. 2016, pp. 1-6.

* cited by examiner

*Primary Examiner* — Dylan White
(74) *Attorney, Agent, or Firm* — Okamoto & Benedicto LLP

(57) ABSTRACT

A light emitting diode (LED) direct AC drive (DACD) circuit includes LED groups that are connected in series. An LED DACD controller includes current regulators that regulate the LED current of the LED groups. The LED DACD controller measures an on-time of an LED group, and regulates the LED current of the LED groups based on the measured on-time of the LED group.

20 Claims, 7 Drawing Sheets

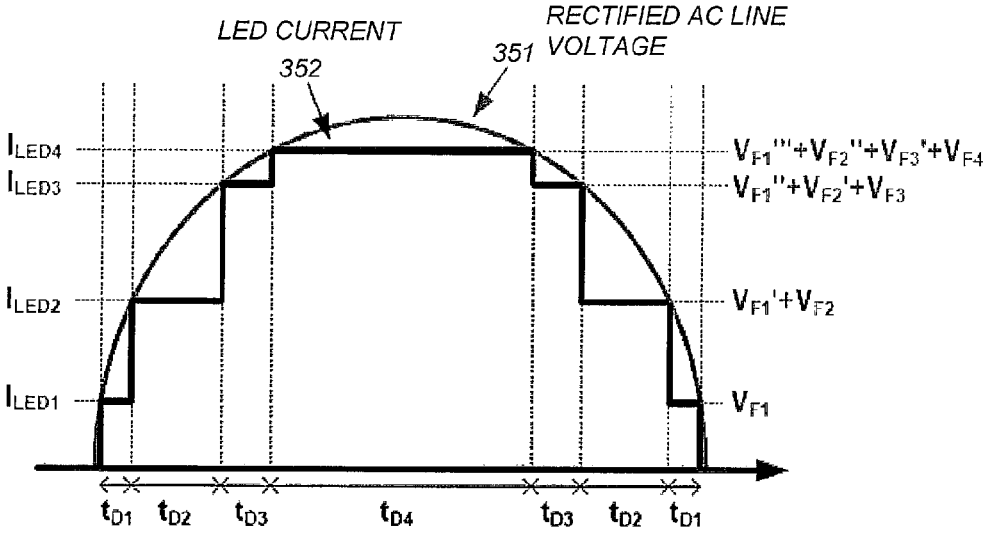

- $t_{D1}$: Current is directed to LED1 pin through 1st LED group.
- $t_{D2}$: Current is directed to LED2 pin through 1st and 2nd LED groups.
- $t_{D3}$: Current is directed to LED3 pin through 1st, 2nd, and 3rd LED groups.
- $t_{D4}$: Current is directed to LED4 pin through 1st, 2nd, 3rd, and 4th LED groups.
- $V_{F1}/V_{F1}'/V_{F1}''/V_{F1}'''$: Forward voltage at forward current of $I_{LED1}/I_{LED2}/I_{LED3}/I_{LED4}$ in 1st LED group.
- $V_{F2}/V_{F2}'/V_{F2}''$: Forward voltage at forward current of $I_{LED2}/I_{LED3}/I_{LED4}$ in 2nd LED group.
- $V_{F3}/V_{F3}'$: Forward voltage at forward current of $I_{LED3}/I_{LED4}$ in 3rd LED group.
- $V_{F4}$: Forward voltage at forward current of $I_{LED4}$ in 4th LED group.

FIG. 2

310

| LED with Nominal Forward Voltage. 65V/40mA | | | |
|---|---|---|---|
| AC Input (V) | 198V | 220V | 242V |
| Luminous Flux (lm) | 987 | 1096 | 1177 |
| IC power loss (W) | 1.248 | 1.883 | 2.714 |

311

| LED with Min Forward Voltage. 59.5V/40mA | | | |
|---|---|---|---|
| AC Input (V) | 198V | 220V | 242V |
| Luminous Flux (lm) | 1091 | 1180 | 1249 |
| IC power loss (W) | 1.68 | 2.516 | 3.48 |

313

312

| LED with Max Forward Voltage. 71.5V/40mA | | | |
|---|---|---|---|
| AC Input (V) | 198V | 220V | 242V |
| Luminous Flux (lm) | 862 | 1004 | 1100 |
| IC power loss (W) | 1.11 | 1.436 | 2.091 |

FIG. 4

LED DIRECT AC DRIVE CIRCUIT

BACKGROUND OF THE INVENTION

1. Field of the Invention

The present invention relates generally to electrical circuits, and more particularly but not exclusively to light emitting diode (LED) circuits.

2. Description of the Background Art

LEDs are used in various lighting applications including for residential/commercial indoor and outdoor lighting. As its name implies, an LED direct AC drive (DACD) circuit includes LEDs that are directly driven by an input AC line voltage. The input AC line voltage is rectified by a rectifier, and the rectified AC line voltage is provided directly to one or more groups of LEDs. The LEDs turn on and provide illumination as the rectified AC line voltage exceeds the forward voltages of the LEDs.

SUMMARY

In one embodiment, a light emitting diode (LED) direct AC drive (DACD) circuit includes LED groups that are connected in series. An LED DACD controller includes current regulators that regulate the LED current through the LED groups. The LED DACD controller measures an on-time of an LED group, and regulates the LED current of the LED groups based on the measured on-time of the LED group.

These and other features of the present invention will be readily apparent to persons of ordinary skill in the art upon reading the entirety of this disclosure, which includes the accompanying drawings and claims.

DESCRIPTION OF THE DRAWINGS

FIG. 2 shows example waveforms that illustrate LED current control in the LED DACD circuit of FIG. 1.

FIG. 4 shows tables that illustrate the effect of LED forward voltage and input AC line voltage to light output and LED DACD controller power loss.

The use of the same reference label in different drawings indicates the same or like components.

DETAILED DESCRIPTION

In the present disclosure, numerous specific details are provided, such as examples of electrical circuits, components, and methods, to provide a thorough understanding of embodiments of the invention. Persons of ordinary skill in the art will recognize, however, that the invention can be practiced without one or more of the specific details. In other instances, well-known details are not shown or described to avoid obscuring aspects of the invention.

Figure 1:
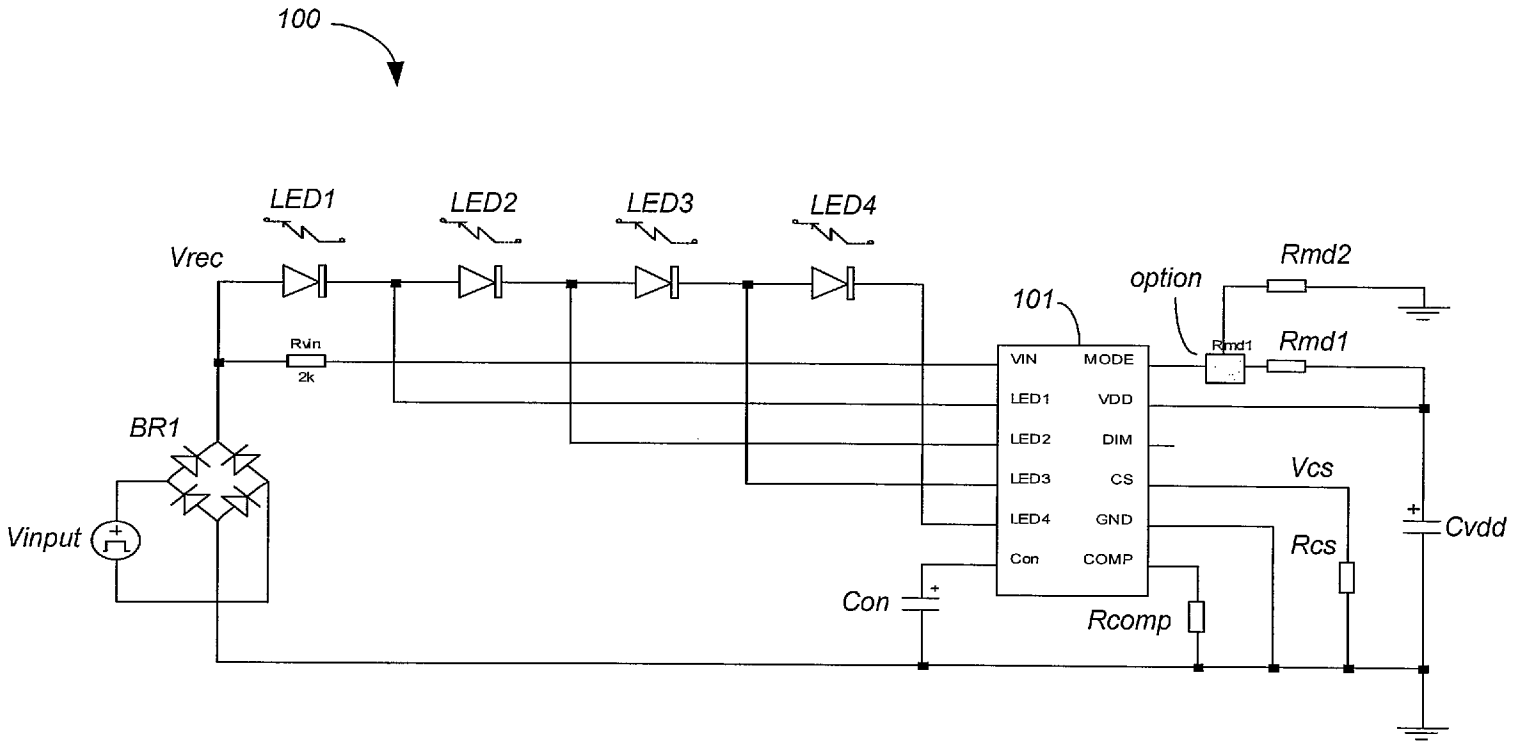
FIG. 1 shows a schematic diagram of an LED DACD circuit in accordance with an embodiment of the present invention.

FIG. 1 shows a schematic diagram of an LED DACD circuit 100 in accordance with an embodiment of the present invention. In the example of FIG. 1, the circuit 100 receives an input AC line voltage Vinput, which is rectified by a rectifier circuit BR1 to generate a rectified AC line voltage Vrec that is provided to one or more LED groups. An LED group may comprise one or more LEDs that are connected in parallel and/or in series to provide group illumination. An LED group has a cathode end that represents the orientation of cathodes of LEDs of the LED group, and has an anode end that represents the orientation of anodes of the LEDs of the LED group. In one embodiment, the cathodes and anodes of LEDs in each LED group are oriented as shown in FIG. 1. As can be appreciated, the LEDs in an LED group may be represented as a single LED for analysis purposes. In the example of FIG. 1, the circuit 100 includes LED groups LED1, LED2, LED3, and LED4 that are connected in series, with the rectified AC line voltage Vrec being connected directly to the anode end of the LED group LED1.

In the example of FIG. 1, the circuit 100 includes an LED DACD controller 101. In one embodiment, the controller 101 is in integrated circuit (IC) form, with a package that includes a plurality pins including a VIN pin for receiving the rectified AC line voltage Vrec, LED1-LED4 pins for connection to the cathode ends of the LED groups LED1-LED4, a Con pin for receiving an on-time capacitor Con, a mode pin for enabling/disabling dimming, a VDD pin for outputting an internally-generated bias voltage, a DIM pin for receiving a dimming signal, a CS pin for receiving a current sense resistor Rcs for LED current sensing, a GND pin for connecting to ground reference, and a COMP pin for receiving a compensation resistor Rcomp for fine LED current adjustment. In the example of FIG. 1, the MODE pin may be connected to ground by way of the resistor Rmd2 to enable dimming functionality or to the VDD pin by way of the resistor Rmd1 to disable dimming. A bypass capacitor Cvdd may be connected to the VDD pin to reduce noise from the rectified AC line voltage.

FIG. 2 shows example waveforms that illustrate LED current control in the LED DACD circuit 100. FIG. 2 shows the LED current (plot 352) through the LED groups LED1-LED4 in relation to the rectified AC line voltage Vrec (plot 351). Generally speaking, each LED group turns on automatically when the rectified AC line voltage Vrec is higher than the forward voltage of the corresponding consecutive LED groups. More particularly, the LED group LED1 turns on when the rectified AC line voltage Vrec becomes higher than the forward voltage of the LED group LED1, the LED groups LED1 and LED2 turn on when the rectified AC line voltage Vrec becomes higher than the forward voltages of the LED groups LED1 and LED2, etc. The LED current is the current through the LED group LED1 when the LED group LED1 is on, the LED current is the current through the LED groups LED1 and LED2 when the LED groups LED1 and LED2 are on, etc. The controller 101 may be configured such that the LED current is precisely controlled so that the mean or RMS current through the LED groups over the input AC line voltage cycle is controlled, thereby providing uniform and controlled light output.

Figure 3:
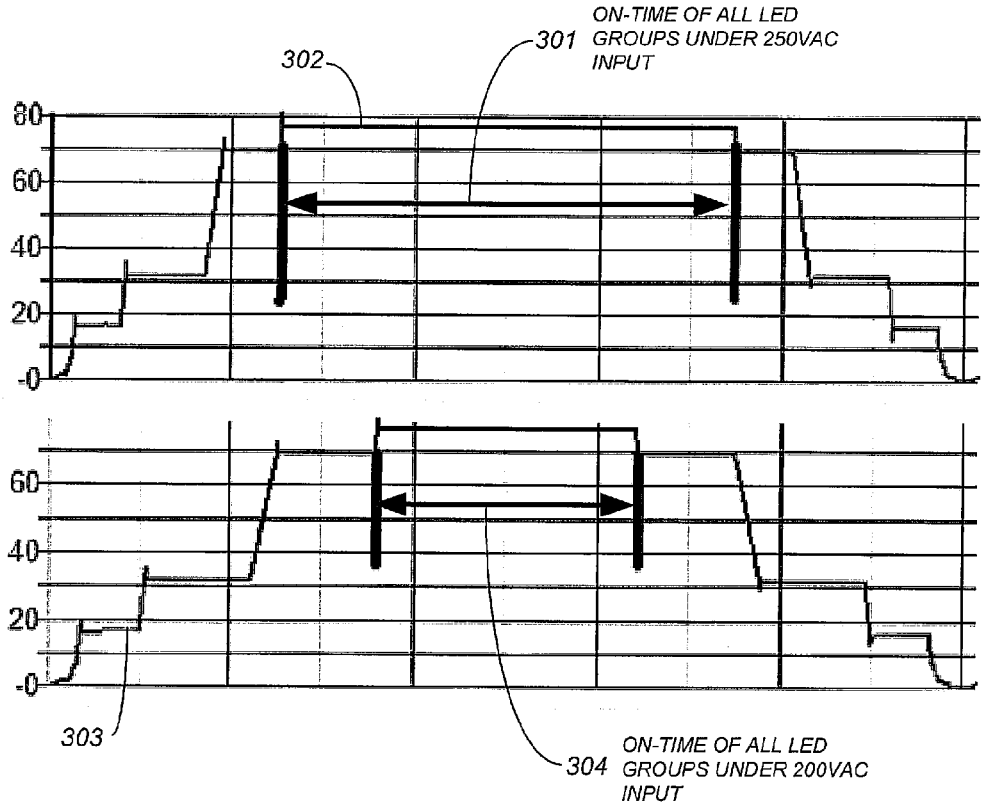
FIG. 3 shows waveforms that illustrate the effect of input AC line voltage variation to LED group on-time.

FIG. 3 shows waveforms that illustrate the effect of input AC line voltage variation to LED group on-time. Generally speaking, the on-time of consecutive LED groups depends on the input AC line voltage level and the forward voltages of the LED groups. Under different input AC line voltage levels or with different LED forward voltages, the LED conduction time will vary. In the example of FIG. 3, the dimension 301 indicates the on-time of the LED groups LED1-LED4 with an input AC line voltage (plot 302) of 250 VAC, and the dimension 304 indicates the on-time of the LED groups LED1-LED4 with an input AC line voltage (plot 303) of 200 VAC. As can be seen from FIG. 3, the on-time of the LED groups becomes shorter as the input AC line voltage becomes lower and vice versa.

FIG. 4 shows tables that illustrate the effect of LED forward voltage and input AC line voltage to light output ("Luminous Flux") and LED DACD controller power loss ("IC power loss"). As can be seen from tables 310-312 of FIG. 4, an LED DACD controller has the highest power loss under the worst operating condition of maximum AC input voltage and minimum LED forward voltage (see cell 313). FIGS. 3 and 4 indicate that the overall LED current mean or RMS value over the input AC line voltage cycle will vary, total LED light output will vary under different input AC line voltage levels or with different LED forward voltages, LED light output will fluctuate as the input AC line voltage varies, and LEDs will have slightly different outputs with LED forward voltage variance.

Figure 5:
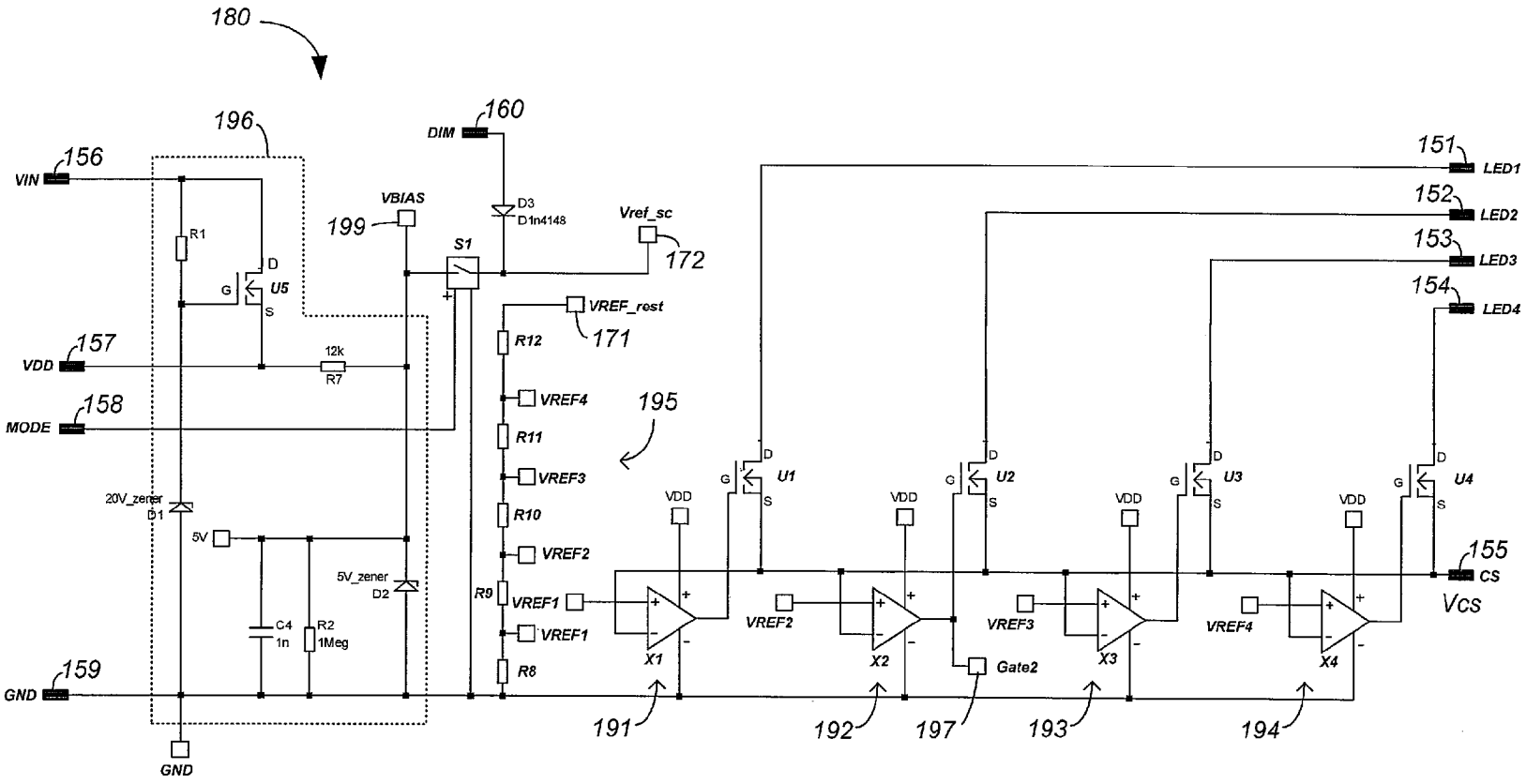
FIG. 5 shows a schematic diagram of a regulation block of an LED DACD controller in accordance with an embodiment of the present invention.

FIG. 5 shows a schematic diagram of a regulation block 180 of the LED DACD controller 101 in accordance with an embodiment of the present invention. FIG. 5 shows pins 151-160, which correspond to the LED1 pin, LED2 pin, LED3 pin, LED4 pin, CS pin, VIN pin, VDD pin, MODE pin, GND pin, and DIM pin, respectively, of the IC package of the controller 101.

In the example of FIG. 5, the regulation block 180 includes a current regulator for each LED group. In one embodiment, the regulation block 180 includes a current regulator 191 comprising an amplifier X1 and a metal oxide semiconductor field effect transistor (MOSFET) U1, a current regulator 192 comprising an amplifier X2 and a MOSFET U2, a current regulator 193 comprising an amplifier X3 and a MOSFET U3, and a current regulator 194 comprising an amplifier X4 and a MOSFET U4.

In the example of FIG. 5, the cathode of the LED group LED1 is connected to the drain of the MOSFET U1, a source of the MOSFET U1 is connected to the negative input terminal of the amplifier X1 and to the CS pin 155, the reference voltage VREF1 is connected to the positive input terminal of the amplifier X1, and the output terminal of the amplifier X1 is connected to a gate of the MOSFET U1. The components of the current regulators 192-194 are connected in the same manner. In one embodiment, the regulating MOSFETs U1-U4 are operated in the linear region. The LED current flows through a conducting MOSFET Un (i.e., U1, U2, U3, and/or U4) and develops an LED current sense voltage Vcs at the current resistor Rcs that is connected to the CS pin 155 (see also FIG. 1). In each of the current regulators 191-194, an amplifier Xn (i.e., X1, X2, X3, or X4) compares a reference voltage (i.e., VREF1, VREF2, VREF3, or VREF4) to the current sense voltage Vcs to thereby form a feedback control of the current flowing through the MOSFET Un and current sense resistor Rcs to ground. The reference voltages VREF1, VREF2, VREF3, VREF4 are set to different values, satisfying the condition $$VREF1<VREF2<VREF3<VREF4,$$

so that the regulator block 180 can turn on/off each of LED groups LED1-LED4 as the level of rectified AC line voltage Vrec changes. As the voltage of the rectified AC line voltage Vrec increases from zero, the rectified AC line voltage Vrec may not be high enough to cause current to flow through the LED groups LED1-LED4. At this stage, the current sense voltage Vcs is lower than the reference voltages VREF1-VREF4, and thus the amplifiers X1-X4 turn on the regulating MOSFET U1-U4, respectively.

As the rectified AC line voltage Vrec increases high enough to turn on the LED group LED1, the current regulator 191, i.e., MOSFET U1 and amplifier X1, conducts and current flows through the LED group LED1, MOSFET U1, and current sense resistor Rcs to ground. When the rectified AC input voltage Vrec is high enough to power the LED group LED1 but not high enough to turn on the LED group LED2, the amplifier X1 compares the current sense voltage Vcs with the reference voltage VREF1, and outputs a corresponding gate drive signal to the gate of MOSFET U1 to regulate the conducting current flowing through the LED group LED1, MOSFET U1, and current sense resistor Rcs.

As the rectified AC line voltage Vrec continues to increase, it reaches a high enough level to power the LED groups LED1 and LED2. Then, the current regulator 192, i.e., MOSFET U2 and amplifier X2, conducts, and the LED groups LED1 and LED2 are turned on. The amplifier X2 compares the current sense voltage Vcs with the reference voltage VREF2 and sends a corresponding gate drive signal to the MOSFET X2. As current starts flowing through the MOSFET U2, the current sense voltage Vcs further increases and exceeds the reference voltage VREF1. At this point, the amplifier X1 outputs the gate drive signal to the gate of the MOSFET U1 to reduce the conducting current of the MOSFET U1. As the rectified AC line voltage Vrec increases further, the conducting current of the MOSFET U2 further increases and the conducting current of the MOSFET U1 further decreases. Eventually, the conducting current of the MOSFET U1 is completely blocked by the amplifier X1 when the reference voltage VREF1 is less than the current sense voltage Vcs. At this point, current only flows through the LED groups LED1, LED2, MOSFET X2, and the current sense resistor Rcs to ground, and is regulated by the amplifier X2. The same operation applies to the subsequent LED groups. Generally, when a downstream LED group is turned on and the current regulator associated with the downstream LED group conducts, the current regulator associated with upstream LED groups can be turned off. Once the rectified AC line voltage Vrec reaches its peak and starts descending, the just-described process reverses so that the current regulator 191 is the last to turn back on.

Put another way, at the beginning of the input AC line voltage cycle, all of the MOSFETs U1-U4 are on because the current sense voltage Vcs is too low due to the low LED current. As the rectified AC line voltage Vrec increases, the LED current increases, which in turn increases the current sense voltage Vcs above the reference voltage VREF1 and thereby turning off the MOSFET U1. The same thing occurs for the MOSFETs U2 and U3 as the rectified AC line voltage Vrec increases. That is, the MOSFETS U1-U3 turn off in sequence, beginning with the MOSFET U1, as the LED current increases due to the rising rectified AC line voltage Vrec. As the rectified AC line voltage Vrec reaches its peak range (i.e., high enough to power on all the LED groups LED1-LED4), only the MOSFET U4 will remain on and regulate the current flowing through the LED groups LED1-LED4. The reverse process occurs as the rectified AC line voltage Vrec decreases from its peak to a level insufficient to keep downstream LED groups on; a downstream LED group is naturally turned off even though its associated regulating amplifier might be on.

In the example of FIG. 5, the reference voltages VREF1-VREF4 are developed from a voltage divider 195 comprising resistors R8-R12. The voltage divider 195 divides the main reference voltage VREF_rest at the node 171 into the reference voltages VREF1-VREF4 that are received by the current regulators 191-194, respectively. The resistance values of the resistors R8-R12 are selected so that the references voltages VREF1-VREF4 allow the MOSFETS U1-U4 to be off/on as the LED current increases/decreases. As will be more apparent below, the main reference voltage VREF_rest may be adaptively varied based on the on-time of an LED group to improve LED current regulation and minimize or eliminate output light fluctuation during AC line voltage perturbation. Varying the main reference voltage VREF_rest varies the reference voltages VREF1-VREF4, thereby controlling the LED current.

In the example of FIG. 5, the rectified AC line voltage on the VIN pin 156 is received by a bias circuit 196 to develop a bias voltage at a node 199. Connecting the MODE pin 158 to the VDD pin 157 closes a switch S1 to disable dimming. On the other hand, connecting the MODE pin 158 to ground opens the switch S1 to enable dimming. When dimming is enabled, a dimming signal on the DIM pin 160 may be employed as a dimming reference voltage Vref_sc at a node 172 to adjust the main reference voltage VREF_rest (see FIG. 6, node 172) and thereby adjust the light output of the LED groups LED1-LED4.

Figure 6:
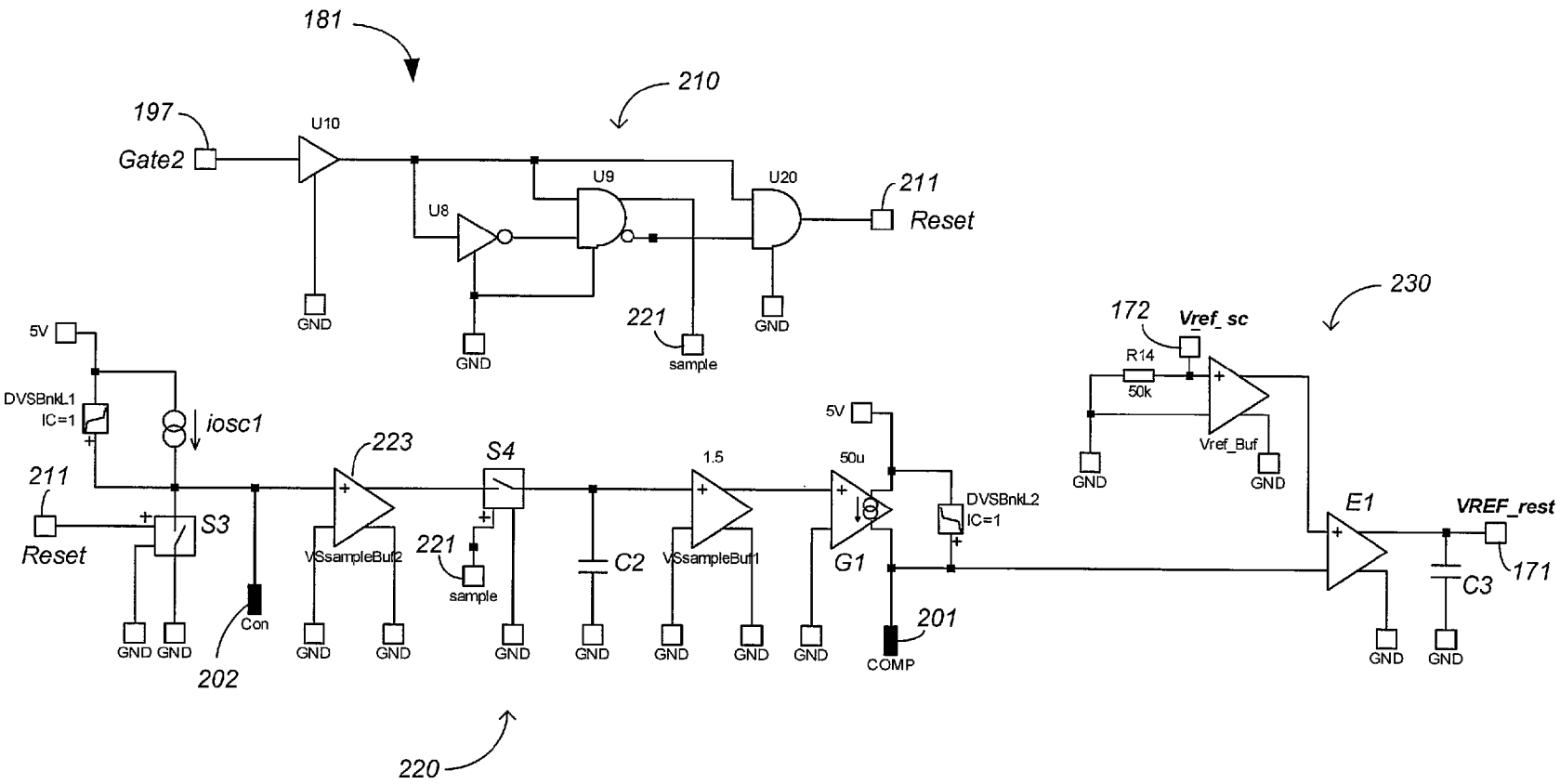
FIG. 6 shows a schematic diagram of an adaptive current controller of an LED DACD controller in accordance with an embodiment of the present invention.

FIG. 6 shows a schematic diagram of an adaptive current controller 181 of the LED DACD controller 101 in accordance with an embodiment of the present invention. In one embodiment, the adaptive current controller 181 and the regulation block 180 are in the IC package of the controller 101. In one embodiment, the adaptive current controller 181 measures the on-time of an LED group and adjusts the main voltage reference VREF_rest in inverse proportion to maintain the LED current to compensate for variation in the levels of the input AC line voltage. In the example of FIG. 6, the adaptive current controller 181 measures the on-time of the LED group LED3 by sensing the gate drive signal Gate2 (see FIG. 5, 197) to the MOSFET U2 of the current regulator 192. As can be appreciated, the present invention is not limited to only sensing the on-time of the LED group LED3, as the adaptive current controller 181 may sense the on-time of the LED group LED1, LED2, or LED4.

In the example of FIG. 6, the adaptive current controller 181 includes a trigger circuit 210, a sampling circuit 220, and a reference voltage generator 230. In one embodiment, the trigger circuit 210 is configured to receive the gate drive signal Gate2 at the node 197, generate at the node 211 a corresponding reset signal for resetting the on-time capacitor Con (FIG. 1, Con) connected at the Con pin 202, and generate a corresponding sampling pulse at the node 221 for sampling the charge accumulated on the on-time capacitor Con.

In one embodiment, the sampling circuit 220 is configured to sense the on-time of the LED group LED3 by charging the on-time capacitor Con during the conduction time of the LED group LED3 and sampling and holding the charge of the on-time capacitor Con in a holding capacitor C2 at the end of the conduction of the LED group LED3. As the rectified AC line voltage increases at the beginning of the input AC line voltage cycle, the LED groups LED1-LED4 turn on in sequence beginning with the LED group LED1. At the onset of conduction of the LED group LED3, the MOSFET U2 is turned off by the amplifier 192 by de-asserting (e.g., driving low) the gate drive signal Gate2 (see FIG. 7, 281). When the gate drive signal Gate2 is de-asserted, the trigger circuit 210 de-asserts the reset signal (see FIG. 7, 282) at the node 211 thereby opening the switch S3 to allow a current source iosc1 to charge the on-time capacitor Con (see FIG. 7, 283) that is connected to the Con pin 202.

As the rectified AC line voltage decreases, the LED groups LED1-LED4 turn off in reverse sequence beginning with the LED group LED4. Once the rectified AC line voltage Vrec decreases to a level insufficient to keep the LED group LED3 on, the current through the LED group LED3 decreases to zero. At that stage, the LED currents flows through the LED group LED1, LED group LED2, and MOSFET U2. At the end of conduction of the LED group LED3, the MOSFET U2 is turned on by the amplifier 192 by asserting the gate drive signal Gate2 (see FIG. 7, 284). In response, the trigger circuit 210 generates the sampling pulse at the node 221 (see FIG. 7, 285), thereby closing the switch S4 for a very short time period (e.g., a few microsecond) to allow the charge on the on-time capacitor Con to be reflected to the holding capacitor C2 by way of a sample buffer 223. Then, after the sampling pulse is de-asserted and the gate drive signal Gate2 is asserted, the trigger circuit 210 asserts the reset signal (see FIG. 7, 286) at the node 211 thereby closing the switch S3 to discharge the on-time capacitor Con (see FIG. 7, 287). The charge on the holding capacitor C2, which represents the on-time of the LED group LED3, is converted by a transconductance amplifier G1 to a current that develops an on-time voltage on the compensation resistor Rcomp (FIG. 1, Rcomp) that is connected to the COMP pin 201. Changing the resistance value of the resistor Rcomp allows for fine tuning of the adaptive current regulation over the entire input AC line voltage range.

In one embodiment, the reference voltage generator 230 is configured to generate the main reference voltage VREF_rest at the node 171. In the example of FIG. 6, the reference voltage generator 230 includes an amplifier E1 that receives the on-time voltage on the COMP pin 201. The amplifier E1 outputs the difference between the on-time voltage and the dimming reference voltage Vref_sc at the node 172 to generate the main reference voltage VREF_rest across the capacitor C3. Accordingly, the main reference voltage VREF_rest varies with the on-time of the LED group LED3. Also, the main reference voltage VREF_rest may be adjusted for dimming by adjusting the dimming reference voltage Vref_sc.

As can be appreciated from the foregoing, the on-time of the LED group LED3 is inversely proportional to the main reference voltage VREF_rest. As the on-time of the LED group LED3 increases (e.g., because of increasing input AC line voltage), the main reference voltage VREF_rest decreases, and the reference voltages (i.e., VREF1, VREF2, VREF3, VREF4) of the current regulators 191-194 proportionately decreases, thereby decreasing the LED current. As the on-time of the LED group LED3 decreases (e.g., because of decreasing input AC line voltage), the main reference voltage VREF_rest increases, and the reference voltages of the current regulators 191-194 proportionately increases, thereby increasing the LED current. Advantageously, adjusting the main reference voltage VREF_rest based on the on-time of the LED group LED3 allows the LED current to be regulated despite varying input AC line voltage and different LED forward voltages.

Figure 7:
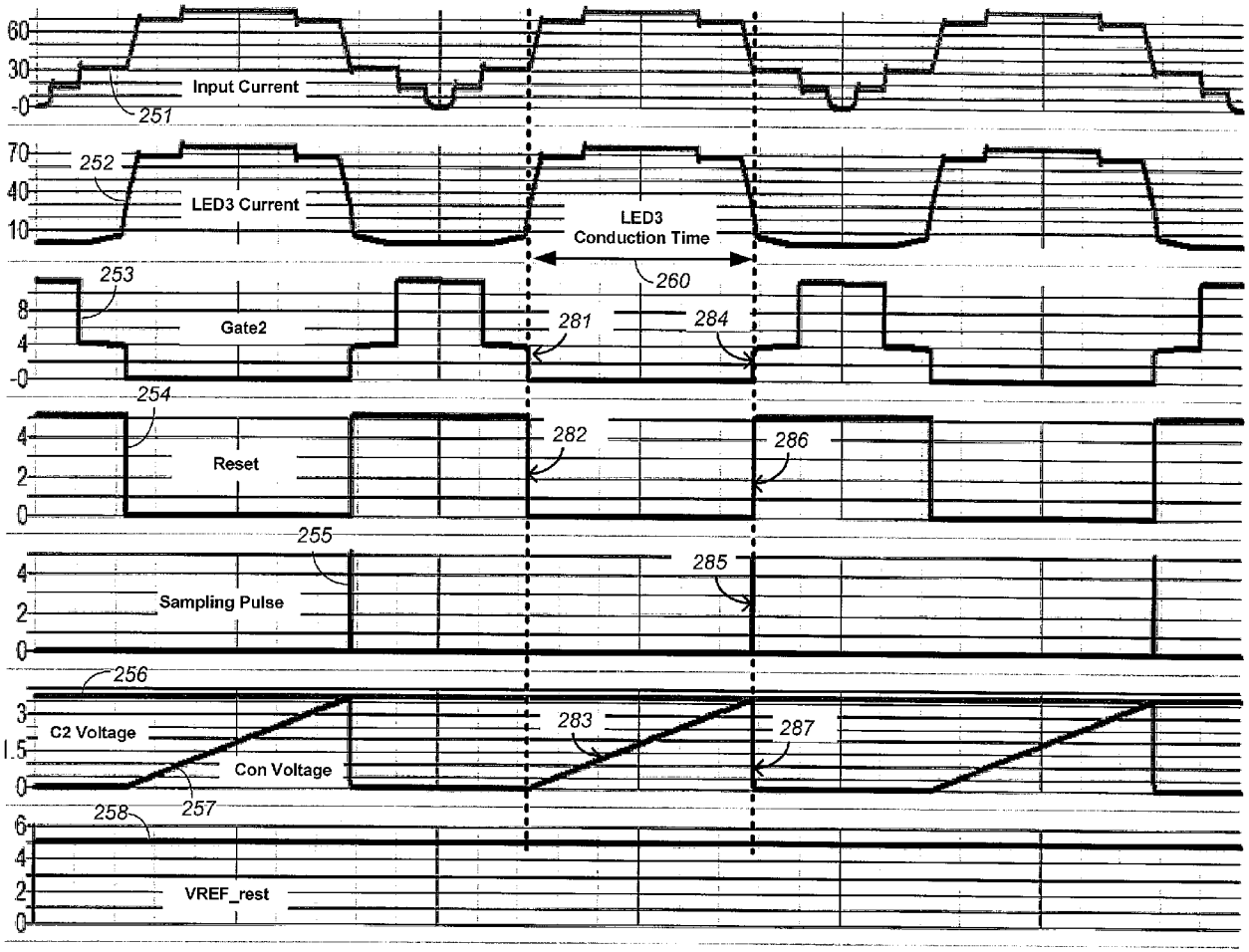
FIG. 7 shows waveforms of signals of the LED DACD circuit of FIG. 1 in accordance with an embodiment of the present invention.

FIG. 7 shows waveforms of signals of the LED DACD circuit 100 in accordance with an embodiment of the present invention. FIG. 7 shows, from top to bottom, the input current of the input AC line voltage (plot 251), the current through the LED group LED3 (plot 252), the gate drive signal Gate2 (plot 253; FIG. 6, node 197), the reset signal generated by the trigger circuit 210 (plot 254; FIG. 6, node 211), the sampling pulse generated by the trigger circuit 210 (plot 255; FIG. 6, node 221), the C2 voltage on the holding capacitor C2 (plot 256; see FIG. 6, C2), the Con voltage on the on-time capacitor Con (plot 257; FIG. 1, Con), and the main reference voltage VREF_rest (plot 258; FIG. 5, node 171).

In an example operation, the LED current of the LED group LED3 is received by the current regulator 193. The on-time of the LED group LED3 (dimension 260) is measured by charging the on-time capacitor Con during the on-time of the LED group LED3. Accordingly, the charge on the on-time capacitor Con increases during the on-time of the LED group LED3. The charging of the on-time capacitor Con (FIG. 7, 283) may be initiated when the gate drive signal Gate2 (FIG. 7, 281) and the reset signal are de-asserted (FIG. 7, 282). At the end of the on-time of the LED group LED3, the gate drive signal Gate2 is asserted (FIG. 7, 284). In response, the charge on the on-time capacitor Con is sampled and held on the holding capacitor C2 by momentarily asserting the sampling pulse (FIG. 7, 285), and the reset signal is asserted (FIG. 7, 286) to reset the on-time capacitor Con (FIG. 7, 287) to get ready for the next cycle. Although not readily apparent from FIG. 7 because of the scale of the plot, the main reference voltage VREF_rest varies in inverse proportion to the charge on the on-time capacitor Con to adjust the LED current in response to varying levels of input AC line voltage. The LED current is thus regulated based on the on-time of the LED group LED3.

Structures and methods for an LED DACD circuit have been disclosed. While specific embodiments of the present invention have been provided, it is to be understood that these embodiments are for illustration purposes and not limiting. Many additional embodiments will be apparent to persons of ordinary skill in the art reading this disclosure.

What is claimed is:

1. A light emitting diode (LED) direct AC drive (DACD) circuit comprising:

a first LED group having a first end connected to receive a rectified AC line voltage; and a first current regulator comprising a first transistor that is connected to a second end of the first LED group, the first current regulator being configured to receive an LED current that flows through the first LED group, to compare a first reference voltage to a current sense voltage to control a conduction of the first transistor, to measure an on-time of the first LED group, and to adjust the first reference voltage based on the measured on-time of the first LED group.

2. The LED DACD circuit of claim 1, further comprising:

a second LED group having a first end connected to the second end of the first LED group; and a second current regulator comprising a second transistor that is connected to a second end of the second LED group, the second current regulator being configured to receive the LED current, and to compare a second reference voltage to the current sense voltage to control a conduction of the second transistor, wherein the first and second reference voltages are generated from a main reference voltage and the main reference voltage is adjusted based on the measured on-time of the first LED group to adjust the first and second reference voltages.

3. The LED DACD circuit of claim 2, further comprising:

a voltage divider that divides the main reference voltage into the first and second reference voltages.

4. The LED DACD circuit of claim 2, further comprising:

an adaptive current regulator that comprises a sampling circuit, the sampling circuit being configured to charge an on-time capacitor during the on-time of the first LED group.

5. The LED DACD circuit of claim 4, wherein the adaptive current regulator further comprises an output circuit that is configured to output the main reference based on the charge on the on-time capacitor.

6. The LED DACD circuit of claim 5, wherein the output circuit comprises an amplifier that outputs the main reference voltage by comparing a dimming reference voltage with an on-time voltage that is indicative of the charge on the on-time capacitor.

7. The LED DACD circuit of claim 2, wherein the first LED group receives the rectified AC line voltage through a third LED group that has a first end and a second end, the second end of the third LED group being connected to the first end of the first LED group, and the second end of the third LED group being connected to an output of a rectifier to directly receive the rectified AC line voltage, the LED DACD circuit of claim 2 further comprising:

a third current regulator comprising a third transistor that is connected to a second end of the third LED group, the third current regulator being configured to receive the LED current, and to compare a third reference voltage to the current sense voltage to control a conduction of the third transistor, wherein the first, second, and third reference voltages are generated from the main reference voltage.

8. A light emitting diode (LED) direct AC drive (DACD) controller integrated circuit (IC) comprising:

a first pin that is configured to be connected to a first end of a first LED group;

a second pin that is configured to be connected to a first end of a second LED group that is in series with the first LED group;

a sampling circuit that is configured to measure an on-time of the second LED group;

a first current regulator comprising a first transistor that receives from the first pin an LED current that flows through the first LED group, the first current regulator being configured to control a conduction of the first transistor based on the measured on-time of the second LED group; and a second current regulator comprising a second transistor that receives from the second pin the LED current that flows through the first and second LED groups, the second current regulator being configured to control a conduction of the second transistor based on the measured on-time of the second LED group.

9. The LED DACD controller IC of claim 8, further comprising:

a divider circuit that divides a main reference voltage into a first reference voltage for the first current regulator and a second reference voltage for the second current regulator, wherein the main reference voltage increases when the on-time of the second LED group decreases, and the main reference voltage decreases when the on-time of the second LED group increases.

10. The LED DACD controller IC of claim 9, wherein the first current regulator comprises:

a first amplifier that compares the first reference voltage to a current sense voltage that is indicative of the LED current to generate a first gate drive signal to the first transistor to control conduction of the first transistor; and a second amplifier that compares the second reference voltage to the current sense voltage to generate a second gate drive signal to the second transistor to control conduction of the second transistor.

11. The LED DACD controller IC of claim 9, wherein the sampling circuit comprises a current source that charges an on-time capacitor during the on-time of the second LED group, and the LED DACD controller IC further comprises:

an output circuit that generates the main reference voltage based on the charge on the on-time capacitor.

12. The LED DACD controller IC of claim 11, wherein the on-time capacitor is external to the LED DACD controller IC and is connected to the sampling circuit by way of a third pin of the LED DACD controller IC.

13. The LED DACD controller IC of claim 11, wherein the sampling circuit further comprises:

a holding capacitor that is configured to receive the charge on the on-time capacitor; and a transconductance amplifier that converts a charge on the holding capacitor to an on-time voltage, wherein the output circuit generates the main reference voltage based on the on-time voltage.

14. The LED DACD controller IC of claim 13, wherein the output circuit comprises an amplifier that compares the on-time voltage to a dimming reference voltage to generate the main reference voltage.

15. A method of controlling a light emitting diode (LED) current of an LED direct AC drive (DACD) circuit, the method comprising:

receiving the LED current, wherein the LED current flows through a first LED group;

measuring an on-time of the first LED group; and regulating the LED current based on the measured on-time of the first LED group.

16. The method of claim 15, wherein measuring the on-time of the first LED group comprises:

charging an on-time capacitor with a current from a current source during the on-time of the first LED group; and at an end of the on-time of the first LED group, sampling and holding a charge of the on-time capacitor.

17. The method of claim 15, wherein regulating the LED current based on the measured on-time of the first LED group comprises:

flowing the LED current through a first transistor; and controlling a conduction of the first transistor based on the measured on-time of the first LED group.

18. The method of claim 15, wherein the LED current flows through the first LED group and a second LED group.

19. The method of claim 18, wherein regulating the LED current based on the measured on-time of the first LED group comprises:

generating a main reference voltage based on the measured on-time of the first LED group;

dividing the main reference voltage into a first reference voltage and a second reference voltage;

using the first reference voltage to control a conduction of a first transistor that receives the LED current; and using the second reference voltage to control a conduction of a second transistor that receives the LED current.

20. The method of claim 19, wherein generating the main reference voltage based on the measured on-time of the first LED group comprises:

charging a capacitor during the on-time of the first LED group; and generating the main reference voltage based on a charge accumulated in the capacitor.

* * * * *